United States Patent [19]

Waring

[11] Patent Number: 4,696,405

[45] Date of Patent: Sep. 29, 1987

[54] GUN RACK

[76] Inventor: Patrick M. Waring, 3800 Spring Valley, #177, Dallas, Tex. 75234

[21] Appl. No.: 874,223

[22] Filed: Jun. 13, 1986

[51] Int. Cl.[4] ..... E05B 73/00

[52] U.S. Cl. ..... 211/4; 211/64; 16/360

[58] Field of Search ..... 211/4, 64, 70.5; 248/551, 552, 553; 292/278, 108; 16/266, 319, 360

[56] References Cited

U.S. PATENT DOCUMENTS

| | | | |
|---|---|---|---|
| 880,318 | 2/1908 | Mattox | 292/108 |
| 1,661,516 | 3/1928 | Vineberg | 211/4 |
| 2,946,452 | 7/1960 | Caloiero et al. | 211/4 |
| 3,291,317 | 12/1966 | Bowen | 211/4 |
| 3,618,785 | 10/1969 | Newman | 211/73 |
| 3,643,811 | 2/1972 | Howerton | 211/47 |
| 3,767,093 | 10/1973 | Pinkerton et al. | 248/553 X |
| 4,139,100 | 2/1979 | Reed | 211/47 |
| 4,182,453 | 4/1978 | Worswick | 211/73 |
| 4,222,490 | 9/1980 | Wood, Jr. | 211/70.5 |
| 4,596,334 | 6/1986 | Daulton | 211/4 X |

*Primary Examiner*—Ramon S. Britts
*Assistant Examiner*—Blair M. Johnson
*Attorney, Agent, or Firm*—Hubbard, Thurman, Turner & Tucker

[57] ABSTRACT

A gun rack includes first and second laterally spaced, upright supporting members for wall attachment. A plurality of gun barrel support brackets are attached to the first support member, and a corresponding plurality of lockable firearm retaining structures are attached to the second support member. Each lockable firearm retaining structure includes a pivotable locking plate having a narrow, straight-sided passage extending inwardly from one side of the locking plate to a circular aperture whose diameter is greater than the passage width; and a rotatable locking plate retainer pin having a diameter corresponding to the diameter of the locking plate aperture and opposing grooves having bottoms forming a straight bar section having a width sufficient to accommodate the width of the narrow passage of the locking plate. Each locking plate retainer pin is rotatably attached to a reciprocally mounted bar within the second support member, and a "Chicago" type lock is attached to the bar. Thus, when firearms are racked with the locking plate retainer pins passing through the trigger guards, the locking plates are pivoted to pass the narrow passage forming walls through the locking plate retainer grooves to position the apertures about the locking plate pins. The lock is then turned ninety degrees driving the bar upward to rotate the locking plate retainer pin grooves out of passage alignment thereby locking the locking plate and firearms to the locking plate retainer pins.

10 Claims, 6 Drawing Figures

GUN RACK

BACKGROUND OF THE INVENTION

This invention relates to racks and more particularly to a gun rack.

In the past, gun racks have included a steel frame having first and second spaced upright standards interconnected by first and second vertically spaced crossbars. The frame is attached to a wall by screws. A plurality of C-shaped gun barrel holders are rigidly attached to the first upright standard.

The second upright standard is a U-shaped channel; the base of which is secured to the wall by screws. Atop L-shaped locking plate, a bottom locking plate, and a plurality of outwardly extending, resilient trigger guard mounting pins or rods are attached to the base of the channel and an apertured plate is positioned over the pins and bottom lock plate and attached to the channel legs.

The top L-shaped locking bar has an outwardly extending plate with a lock hasp receiving aperture formed adjacent to its outer end; the bottom locking plate has a rectangular slot formed adjacent to its outer end.

An apertured lock bar completes the gun rack. The top end of the lock bar has a horizontal inwardly extending leg having a lock hasp receiving aperture corresponding to the aperture of the L-shaped lock member. The bottom end of the lock bar has a recessed portion forming a rectangular bar corresponding in size to the aperture of the bottom locking plate and shoulders for positioning the bar in the bottom lock member with the trigger guard pin apertures and the lock hasp perture aligned to receive, respectively, the trigger guard pins and the hasp of a lock. Thus, when the trigger guard of a rifle is mounted on the trigger guard pins with the rifle barrel in a corresponding C-shaped rifle barrel support and the lock bar attached by a lock the rifle is secure against removal. Those persons skilled in the art desiring more information concerning this prior art gun rack are referred to U.S. Pat. No. 4,139,100 issued Feb. 13, 1979 to Presley O. Reed.

Other gun rack structures are disclosed in U.S. Pat. Nos. 4,182,453 issued Jan. 8, 1980 to Alan Worswick for a Tack for Displaying and Securing Guns; 3,618,785 issued Nov. 9, 1971 to Albert G. Newman for Gun Rack and 3,643,811 issued Feb. 22, 1972 to Glen Howerton for a Locking Gun Rack.

A problem with existing gun racks is their inadequacy for securing weapons in police or military or both armories against theft. Another problem is the degree of installation difficulty to ensure a virtually burglar proof system. A further problem is the time required for storing, locating and positioning rack components, such as, for example, the locking bar and lock used to secure the weapons in the rack.

SUMMARY OF THE INVENTION

Accordingly, it is an object of this invention to provide an improved gun rack which is inexpensive, subject to mass production, and easy to install.

Another object of the invention is to provide a gun rack which is virtually burglar proof.

A further object of the invention is to provide a gun rack whose simple operation minimizes the time required for securing weapons thereby encouraging use by rifle users.

Briefly stated, the invention comprises a gun rack including support members having wall connectors whose accessibility are protected by the racked firearms. Pivotble locking plates having specially shaped notches, and locking plate retainer pins designed to receive the locking plates by their notches are operatively connected to a support member. The locking plates are pivotable away from the locking plate retainer pins for gun removal and racking. Gun racking is accomplished by positioning the firearms between the locking plates and locking plate retainer pins with the pins passing through the trigger guards of the firearms, and pivoting the locking plates to the locking plate retainer pins for locking. Locking is accomplished by rotating the locking plate retainer pins in the locking plate notches whereby the locking plates are locked to the latch locking pins to secure the firearms from theft.

BRIEF DESCRIPTION OF THE DRAWINGS

Other objects and features of the invention will become more readily understood from the following detailed description and appended claims when read in conjunction with the accompanying drawings in which:

DESCRIPTION OF A PREFERRED EMBODIMENT

Figure 1:
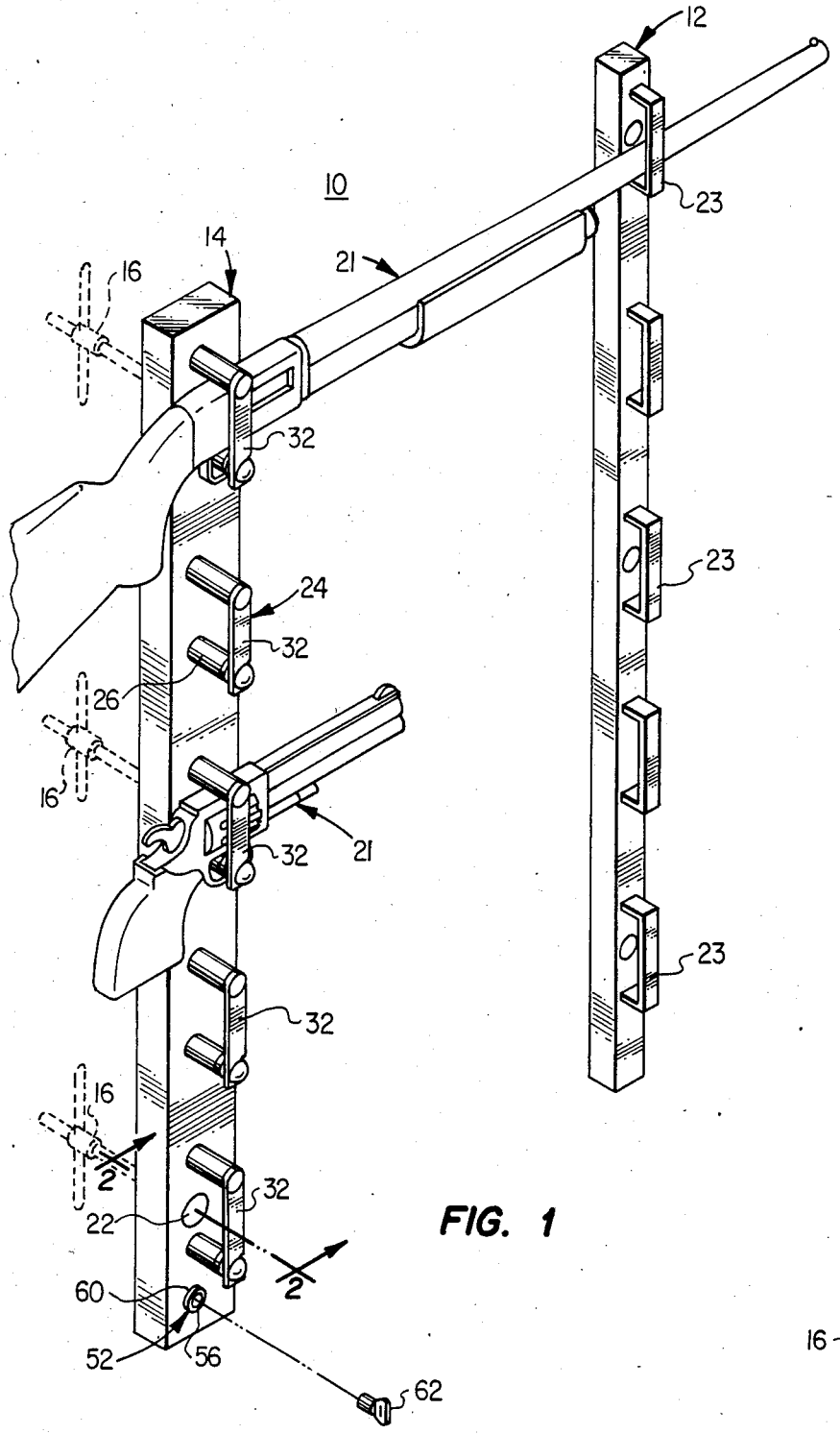
FIG. 1 is an isometric view of the gun rack constituting the subject matter of this invention.
Figure 2:
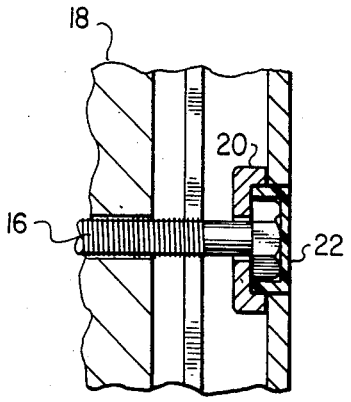
FIG. 2 is a partial view partly in cross section showing in detail a gun rack support mounting structure forming a part of the invention.

The gun rack 10 (FIG. 1) constituting the subject matter of this invention includes a firearm supporting means having first and second laterally spaced support members 12 and 14. The support members are preferably steel channel members. Stell bolts such as, for example, molley bolts 16 (FIGS. 1 and 2) secure the support members to a permanent structure 18 (FIG. 2) such as, for example, a concrete wall or floor. The support member bolts 16 securing the first support member to the structure are positioned in recessed areas 20 of the support members where they are rendered unaccessible by the racked weapons 21 (FIG. 1). Caps 22 of suitable material such as, for example, a soft rubber or plastic are mounted in the recesses to cover the heads of the bolts to protect the overlying firearms.

The support members 12 and 14 support a plurality of firearm retaining means of which 5 are shown for illustration purposes only and not by way of limitatio. The retaining means includes, on the first support member 12, a plurality of gun barrel mounting means 23 such as, for example, metal brackets, and, on the second support member 14, a plurality of locking plate means 24 and a plurality of locking plate retaining means 26. The locking plate means and locking plate retaining means are preferably made of Rockwall heated steel.

Each locking plate means 24 (FIG. 3) of the plurality of locking plate means includes an outwardly extending locking plate supporting pin or bolt 28 rigidly secured to the interior of support member 14 by a nut. A spacing sleeve 30 is mounted on the pin 28 to abut the exterior of support member 14 and to space therefrom a locking plate.

Figure 3:
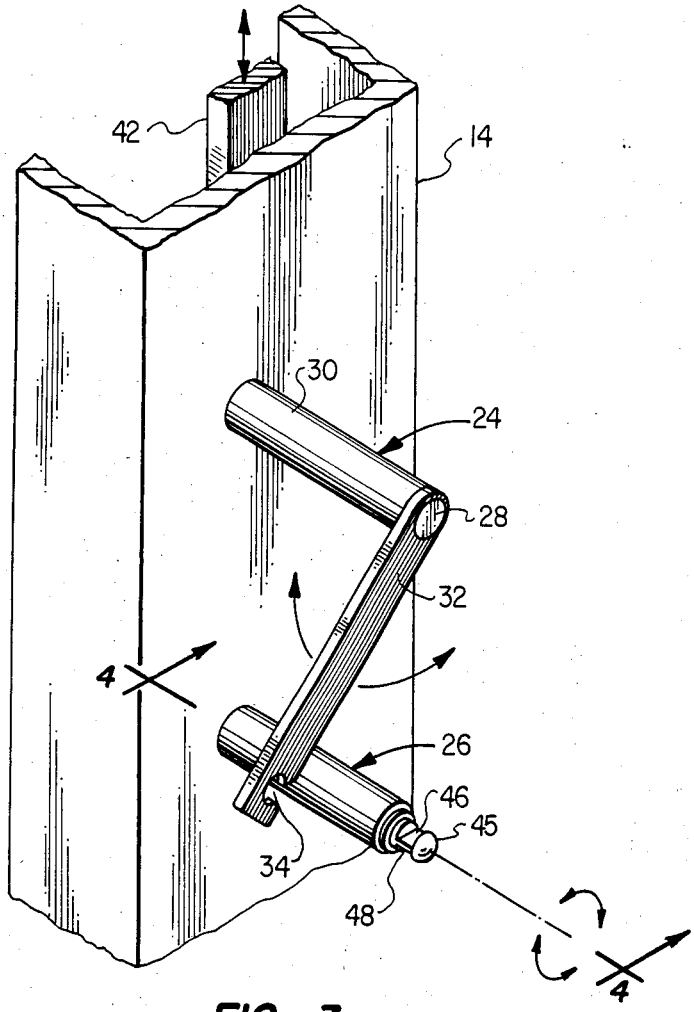
FIG. 3 is a partial isometric view of a part of the firearm retainer of the gun rack of FIG. 1 with the firearm removed.

Locking plate 32 is pivotally mounted on the locking plate supporting pin and retained adjacent the outer end thereof by the spacing sleeve 30. Walls of the locking plate 32 form a notch 34 shaped as shown in FIG. 3 which includes a channel portio formed by a pair of spaced, straight inwardly slanting sides having open ends for forming an open passge extending inwardly from one side of the locking plate to a circularly shaped aperture wall with which it is in open communication for purposes hereinafter described.

Figure 4:
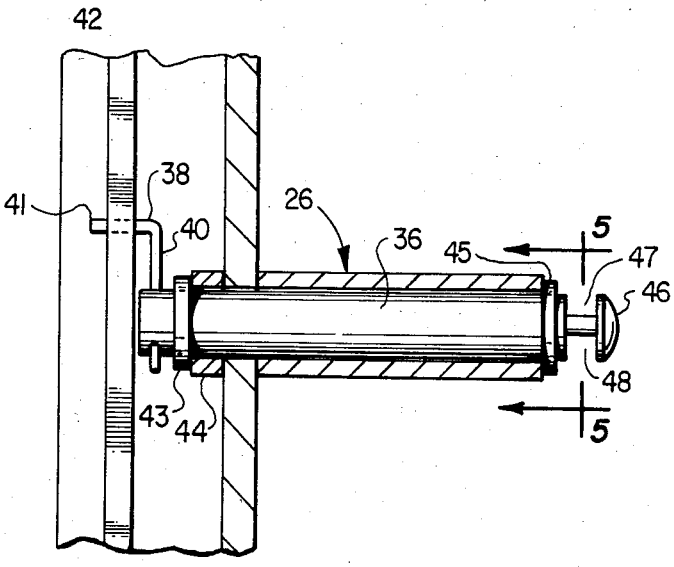
FIG. 4 is a partial view partly in cross section showing in detail the locking plate retainer member of the firearm retainer of FIG. 3.

The locking plate retaining means 26 (FIGS. 3 and 4) includes an outwardly extending circular pin 36 and an L-shaped pin 38 having a leg 40 extending parallel to the interior base of the channel support member 26 into an aperture provided at a first end of the latch retaining means and an inwardly extending leg 41 contiguous with the leg 40, but normal thereto which is connected to an apertured plate 42 through an aperture thereof.

Figure 5:
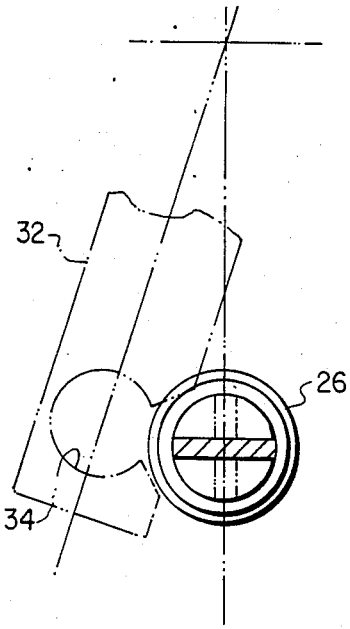
FIG. 5 is a cross sectional view of the locking plate retainer member taken along line 4-4 of FIG. 4 positioned to receive the locking plate notch shown in dashed lines and showing in dotted lines the locking retainer member in the locking position.

The outwardly extending pin 36 passes through a washer 43, first sleeve 44, the channel member 14, a second spacing sleeve 44 and a sleeve retaining washer 45 to a flanged end 46. The leg 36 is, for example, a circular steel rod having a diameter corresponding to the diameter of the circular aperture of the locking plate opening 34, and a pair of opposing parallel grooves 47 and 48 having straight bottoms forming a bar having a width sufficient to pass the locking plate passage to the circular aperture. (FIG. 5).

Figure 6:
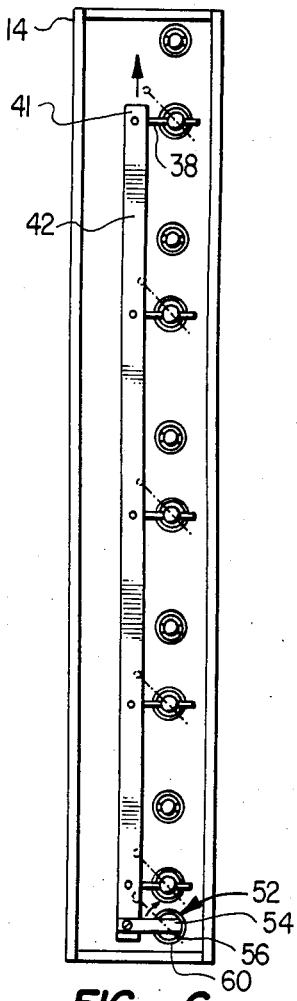
FIG. 6 is a back elevation view of the invention.

Apertured plate 42 (FIGS. 4 and 6), which is attached to leg 41 of the L-shaped pin 38, is reciprocally mounted in the channel support member 14 and has a lower end portion extending below the lowest firearm retaining means.

A lock means 52 includes an L-shaped member of a circular cross section having a first leg 54 rotatably attached to the lower end portion of the apertured plate 42 and a second leg 56 normal to the first leg which extends outwardly through a sleeve 60 mounted in the support means 14. jThe outer end portio of the second leg 56 has a specially notched periphery forming a coded member of a lock for receiving a lock key 62 (FIG. 1) having a bore with lands corresponding to the peripheral notches of the second leg.

In operation, assuming the gun rack is unlocked, firearms having trigger guards (FIG. 1) such as, for example, rifles or pistols or both, may be racked. If a rifle is to be racked, the rifle barrel is inserted in the brackets of the support member 12 and the rifle butt is positioned between the locking plate pin and locking plate retainer pin with the locking plate retainer pin passing through the trigger guard. If a pistol is to be racked, the handle is inserted between the locking plate pin and locking plate retainer pin with the locking plate retainer pin passing through the trigger guard. The firearm locking plates 32 are pivoted over the firearms with the narrow passage forming walls of the notches passing through the grooves of the locking plate retainer pins 36 (FIG. 4) until the circular apertures of the locking plates receive the locking plate retainer pins.

Next, the lock key 62 (FIG. 1) is inserted and turned ninety degrees to rotate the L-shaped lock member to drive the apertured plate 42 upwardly. The upward motion of the bar plate 42 raises legs 41 of the L-shaped pin 38 to rotate the locking plate retainer pins 36 ninety degrees. When so rotated, the grooves of the locking plate retainer pins 41 are out of alignment with the narrow walls of the locking plate openings and the locking plate retainer pins are locked in the paertures of the locking plates (FIG. 5). In this manner the firearms, whether rifles or pistols, are locked into the gun rack.

It will be appreciated by those persons skilled in the art that, with the gun rack structure of this inventio, easy access to the firearms by a child when the rack is unlocked is made difficult by the locking plates.

Although only a single embodiment of the invention has been illustrated and described, it will be obvious to those persons skilled in the art that changes and modifications can be made without departing from the scope of the invention.

What is claimed is:

1. A gun rack comprising:

first and second channel shaped support members;

a plurality of gun barrel support brackets operatively connected to the first support member;

a plurality of locking plate means including a plurality of locking plates pivotally mounted in a spaced relationship to the second support member, said locking plates having walls forming passages in open communication with aperture walls for forming apertures positioned interiorly of the locking plates with open access passages;

a corresponding plurality of locking plate retainer pins operatively connected to the second support means, said locking plate retainer pins extending outwardly of the second support means and having adjacent to ends thereof pairs of grooves on opposing sides for passing the open passage forming walls of the locking plates and for engaging the aperture walls of the locking plates with the locking plate retainer pins;

an apertured lock member reciprocally mounted within the second support member and L-shaped connectors having first and second legs mounted to each other, said apertured lock member having a plurality of vertically spaced apertures through which the first portions of the L-shaped connectors pass and the locking plate retainer pins have apertures through which the second portions of the L-shaped connectors pass; and a lock means including an L-shaped lock member having first and second leg portions normal to each other, the first leg portion having an end operatively connected to the apertured lock member, a sleeve mounted in the second support member for forming a passage therethrough for the outwardly extending second leg portion, said second leg portion having a circular cross section and a plurality of spaced notches formed in the periphery thereof adjacent to the end, whereby a key having a bore with lands corresponding to the notches of the second leg portion rotates the second leg portion of the lock to raise the second leg portion of the L-shaped lock member, apertured plate, and first leg portions of the L-shaped connectors for rotating the second portions and the locking plate retainer pins to lock the locking plates to the locking plate retainer pins.

2. A gun rack for supporting a plurality of firearms each having a trigger guard comprising:

an elongated, generally channel shaped supporting means; and firearm retaining means connected to the supporting means, said firearm retaining means including a locking plate means having an outwardly extending firearm retaining pin having first and second ends, the first end connected to the supporting means, a locking plate having a first end pivotally connected to the second end of the in and a locking plate retainer pin slot formed adjacent to a second end of the locking plate; a locking plate retaining means including a retainer pin for the locking plate and firearm trigger guard, the retainer pin mounted on the supporting means for rotation about its longitudinal axis; and a locking means located within said generally channel shaped supporting means and connected to the retainer pin in the supporting means and which rotates the retainer pin and selectively locks the locking plate and firearm trigger guard by engaging and disengaging the locking plate.

3. A gun rack comprising:

a supporting means; and a firearm retaining means operatively connected to the supporting means, said firearm retaining means including a locking plate retainer means having a locking plate retainer pin and a locking plate means having a locking plate supporting pin operatively connected to the firearm supporting means, and a locking plate operatively connected to the locking plate supporting pin for engaging the locking plate retainer means in a locking relationship, said locking plate including a plate having walls defining an open passage extending inwardly of a side of the locking plate to an aperture, and defining an aperture in open communication with the passage, said aperture having a dimension greater than the width of the open passage for receiving the locking plate retainer pin; said locking plate retaining means including a locking plate locking means for producing locking action with said locking plate retainer pin, wherein the locking plate retainer pin is a circular pin having a first end, said pin having walls forming opposing flat-bottomed grooves adjacent to the first end, said opposing flat-bottomed grooves forming straight parallel bar surfaces having a width corresponding to the width of the passage to the paerture of the locking plate whereby the locking plate passage forming walls can pass through the grooves of the locking plate retainer pin and the locking plate retainer pin partially rotated by the lock means for misaligning the grooves with respect to the open pasage thereby locking the locking plate retainer pin in the aperture of the locking plate, and wherein the locking plate retainer pin includes an L-shaped member having a first leg portion normal to a second leg portion, the first leg portion operatively connected to the locking plate retainer pin, and the second leg portion operatively connected to the lock means for raising the second leg portion for rotating the first leg portion and locking plate retainer pin pursuant to the action of the lock means, said locking plate retainer pin responsive to the locking action for locking the locking plate of the locking plate means to the locking plate retaining pin whereby a firearm mounted on the locking plater retaining pin by its trigger guard is locked to the gun rack.

4. a gun rack according to claim 4 wherein the locking plate retainer pin slot includes walls defining an open latch passage extending inwardly of a side of the locking plate to an aperture, and defining an aperture in open communication with the passage, said aperture having a dimensio greater than the width of the open passage for retaining the locking plate retainer pin for securing a firearm positioned behind the locking plate.

5. A gun rack according to claim 2 wherein the locking plate means further includes a sleeve operatively mounted on the firearm retaining pin intermediate the supporting means and locking plate for spacing the locking plate from the supporting means for aligning the locking plate retainer pin slot with the locking plate retainer pin for securing a firearm positioned behind the locking plate.

6. A gun rack according to claim 4 wherein the locking plate retainer pin is a circular pin having a first end, said pin having walls forming opposing flat-bottomed grooves adjacent to the first end, said opposing flat-bottom grooves forming straight parallel bar surfaces having a width corresponding to the width of the passage to the aperture of the locking plate whereby the locking plate passage forming walls can pass through the grooves of the locking plate retainer pin and the locking plate retainer pin partially rotated by the lock means for misaligning the grooves with respect to the latch passage thereby locking the locking plate retainer pin in the aperture of the locking plate.

7. A gun rack according to claim 6 wherein the first end of the retainer pin for the locking plate and trigger guard has outwardly extending flanges for providing a locking plate retaining knob end whereby additional support is given the locking plate against outwardly directed locking plate bending forces.

8. A gun rack according to claim 7 further including a spacing sleeve for spacing the locking plate from the support member whereby additional support is given to the locking plate against inwardly directed locking plate bending forces and to the trigger guard.

9. A gun rack according to claim 3 wherein the lock means includes an apertured plate reciprocally mounted in the support member, said second leg portion of the L-shaped member mounted within an aperture of the apertured plate, and an L-shaped lock member having first and second leg portions, the first leg portion being normal to the second leg portion and having an end pivotally secured to the apertured plate, a sleeve forming a passage through the support member, and the second leg portion extending outwardly through the sleeve, said second leg portion having a notched periphery adjacent to its end for forming a coded periphery whereby the rotation of a key having a bore with lands corresponding to the notches of the coded periphery rotates the first leg portion to raise the second leg portion, the apertured plate, and the second portion of the L-shaped locking plate retainer pin for rotating the first portion and locking plate retainer pins for locking the locking plate to the locking plate retainer pin.

10. A gun rack according to claim 2 wherein the firearm supporting means comprises a support member and a connector means for rigidly securing said support member to a fixed structure, said support member supporting the locking plate means and locking plate retainer means, said connector means positioned with respect to the locking plate means and locking plate retainer means whereby access to the connector means for removal is blocked by racked firearms.

* * * * *